US007198581B1

(12) United States Patent
Black

(10) Patent No.: US 7,198,581 B1
(45) Date of Patent: Apr. 3, 2007

(54) TRAINING BAT SYSTEM

(76) Inventor: Donald E. Black, 213 Woodstock Dr., Van Wart, OH (US) 45891

( * ) Notice: Subject to any disclaimer, the term of this patent is extended or adjusted under 35 U.S.C. 154(b) by 80 days.

(21) Appl. No.: 10/766,434

(22) Filed: Jan. 26, 2004

Related U.S. Application Data

(63) Continuation-in-part of application No. 10/189,904, filed on Jul. 2, 2002, now Pat. No. 6,682,447.

(51) Int. Cl.
*A63B 69/00* (2006.01)

(52) U.S. Cl. ..... 473/454; 473/519; 473/564

(58) Field of Classification Search ..... 473/457, 473/451, 422, 566, 519, 564; 482/109
See application file for complete search history.

(56) References Cited

U.S. PATENT DOCUMENTS

| | | | | |
|---|---|---|---|---|
| 829,749 | A * | 8/1906 | Adorjan | 473/47 |
| 2,379,006 | A * | 6/1945 | Johnson | 473/568 |
| 3,116,926 | A * | 1/1964 | Owen et al. | 473/457 |
| 3,737,649 | A * | 6/1973 | Nelson et al. | 362/102 |
| 4,600,193 | A * | 7/1986 | Merritt | 473/566 |
| 4,644,630 | A * | 2/1987 | Blum | 29/453 |
| 4,682,773 | A * | 7/1987 | Pomilia | 473/457 |
| 5,149,092 | A * | 9/1992 | Parsons | 463/47.7 |
| 6,682,447 | B1 * | 1/2004 | Black | 473/457 |
| 6,918,843 | B1 * | 7/2005 | Franssen | 473/457 |
| 2002/0193187 | A1 * | 12/2002 | Bickel et al. | 473/457 |

* cited by examiner

*Primary Examiner*—Eugene Kim
*Assistant Examiner*—M. Chambers
(74) *Attorney, Agent, or Firm*—Jerry Semer

(57) ABSTRACT

A training bat system for increasing the batting skills of a baseball player. The training bat system includes a tubular member having a center bore, a plurality of weight members removably positioned within the center bore, an inner cap secured to an inner end of the tubular member, and an outer cap secured to the outer end of the tubular member. A compression spring is preferably positioned between the weight members and the inner cap for maintaining the weight members non-movably adjacent one another. The tubular member in the preferred embodiment has an outer diameter similar to a handle grip of a baseball bat. The tubular member's outer diameter over the area of the bat used for hitting a ball is much smaller than a conventional bat. The tubular member's length is similar to a conventional bat.

14 Claims, 5 Drawing Sheets

TRAINING BAT SYSTEM

This application is a continuation-in-part of application Ser. No. 10/189,904 filed Jul. 2, 2002 now U.S. Pat. No. 6,682,447.

BACKGROUND OF THE INVENTION

1. Field of the Invention

The present invention relates generally to baseball bat training devices and more specifically it relates to a training bat system for increasing the batting skills of a baseball player.

2. Description of the Related Art

Batter training devices have been in use for years. A commonly utilized batter training device is comprised of a weight having a ring structure that surrounds the barrel of a baseball bat often times referred to as a "doughnut." The weight placed upon a conventional baseball bat increases the overall weight of the baseball bat and the player then swings the baseball bat repeatedly with the weight placed upon thereof.

While weights for baseball bats assist the player in developing increased strength, they do not assist the player in developing increased ball engagement accuracy. Conventional baseball bat devices do not significantly increase the mental and physical focus required to engage a baseball with the bat.

Examples of patented devices which may be related to the present invention include U.S. Pat. No. 3,116,926 to Owen et al.; U.S. Pat. No. 6,050,908 to Muhlhausen; U.S. Pat. No. 4,682,773 to Pomilia; U.S. Pat. No. 339,621 to Briden; U.S. Pat. No. 6,280,353 to Brundage; U.S. Pat. No. 5,741,193 to Nolan; and U.S. Pat. No. 5,456,461 to Sulllivan.

While these devices may be suitable for the particular purpose to which they address, they are not as suitable for increasing the batting skills of a baseball player. Conventional baseball bat training devices do not significantly assist with developing mental and physical focus for engaging a baseball.

In these respects, the training bat system according to the present invention substantially departs from the conventional concepts and designs of the prior art, and in so doing provides an apparatus primarily developed for the purpose of increasing the batting skills of a baseball player.

BRIEF SUMMARY OF THE INVENTION

In view of the foregoing disadvantages inherent in the known types of baseball bat training devices now present in the prior art, the present invention provides a new training bat system construction wherein the same can be utilized for increasing the batting skills of a baseball player.

The general purpose of the present invention, which will be described subsequently in greater detail, is to provide a new training bat system that has many of the advantages of the baseball training devices mentioned heretofore and many novel features that result in a new training bat system which is not anticipated, rendered obvious, suggested, or even implied by any of the prior art baseball training devices, either alone or in any combination thereof.

To attain this, the present invention generally comprises a tubular member having a center bore, a plurality of weight members removably positioned within the center bore, an inner cap secured to an inner end of the tubular member, and an outer cap secured to the outer end of the tubular member. A compression spring is preferably positioned between the weight members and the inner cap for maintaining the weight members non-movably adjacent one another. The tubular member is comprised of a tube having an outer diameter similar to a handle gripping of a baseball bat.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a training bat system that will overcome the shortcomings of the prior art devices.

A second object is to provide a training bat system for increasing the batting skills of a baseball player.

Another object is to provide a training bat system that increases a baseball player's mental and physical focus for making contact with a baseball.

An additional object is to provide a training bat system that may be utilized within various sports that utilize a bat to engage a ball such as but not limited to baseball, softball and similar sports.

A further object is to provide a training bat system that improves the hand and eye coordination of a player.

Another object is to provide a training bat system that may be utilized by individuals of various ages, sizes and skill levels.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
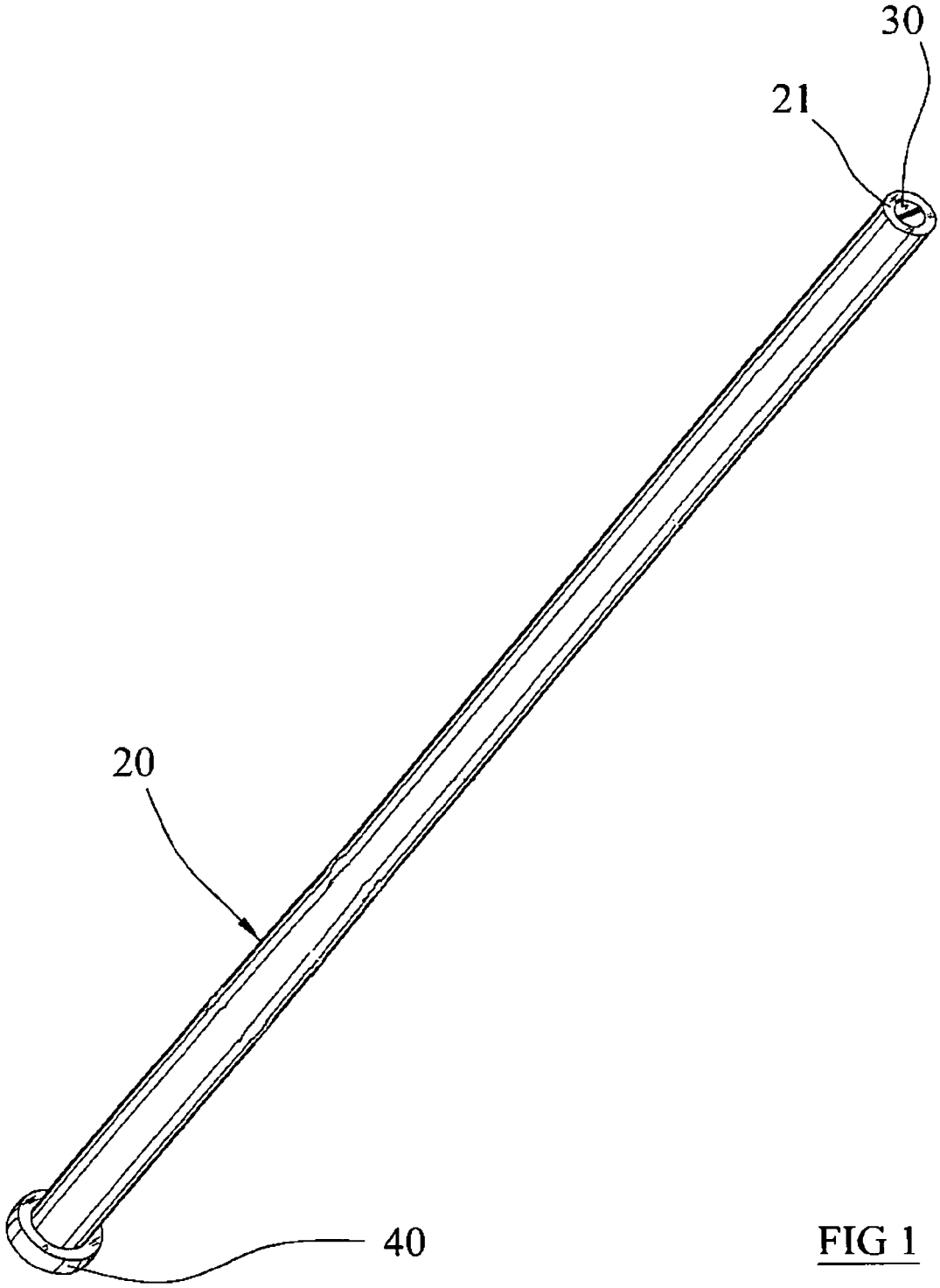
FIG. 1 is an upper perspective view of the present invention.
Figure 2:
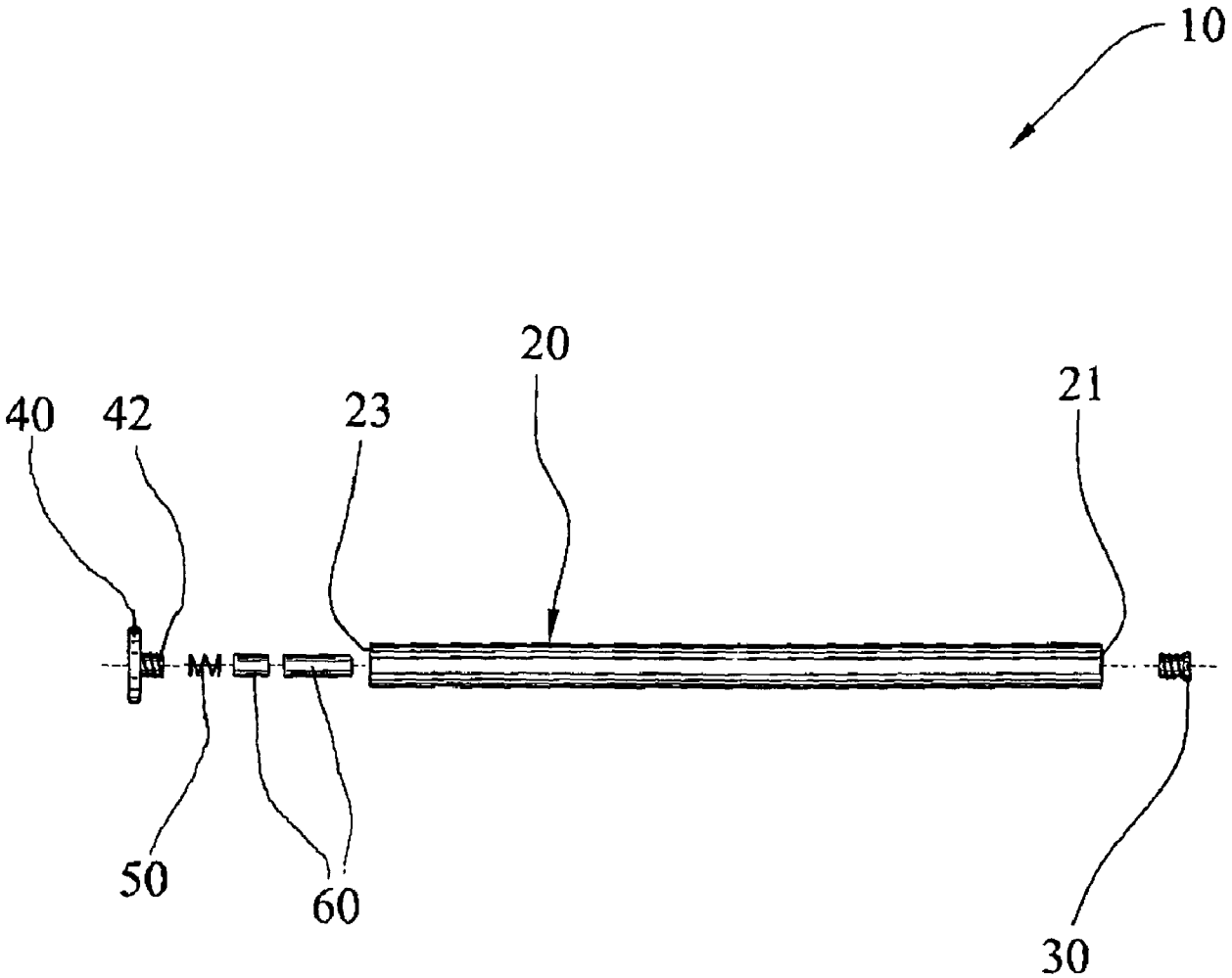
FIG. 2 is a side exploded view of the present invention.

Turning now descriptively to the drawings, in which similar reference characters denote similar elements throughout the several views, FIGS. 1 through 5 illustrate a training bat system 10, which comprises a tubular member 20 having a center bore 27, a plurality of weight members 60 removably positioned within the center bore 27, an inner cap 40 secured to an inner end 23 of the tubular member 20, and an outer cap 30 secured to the outer end of the tubular member 20. A compression spring 50 is preferably positioned between the weight members 60 and the inner cap 40 for maintaining the weight members 60 non-movably adjacent one another. The tubular member 20 has an outer diameter similar to a handle gripping of a baseball bat.

Figure 3:
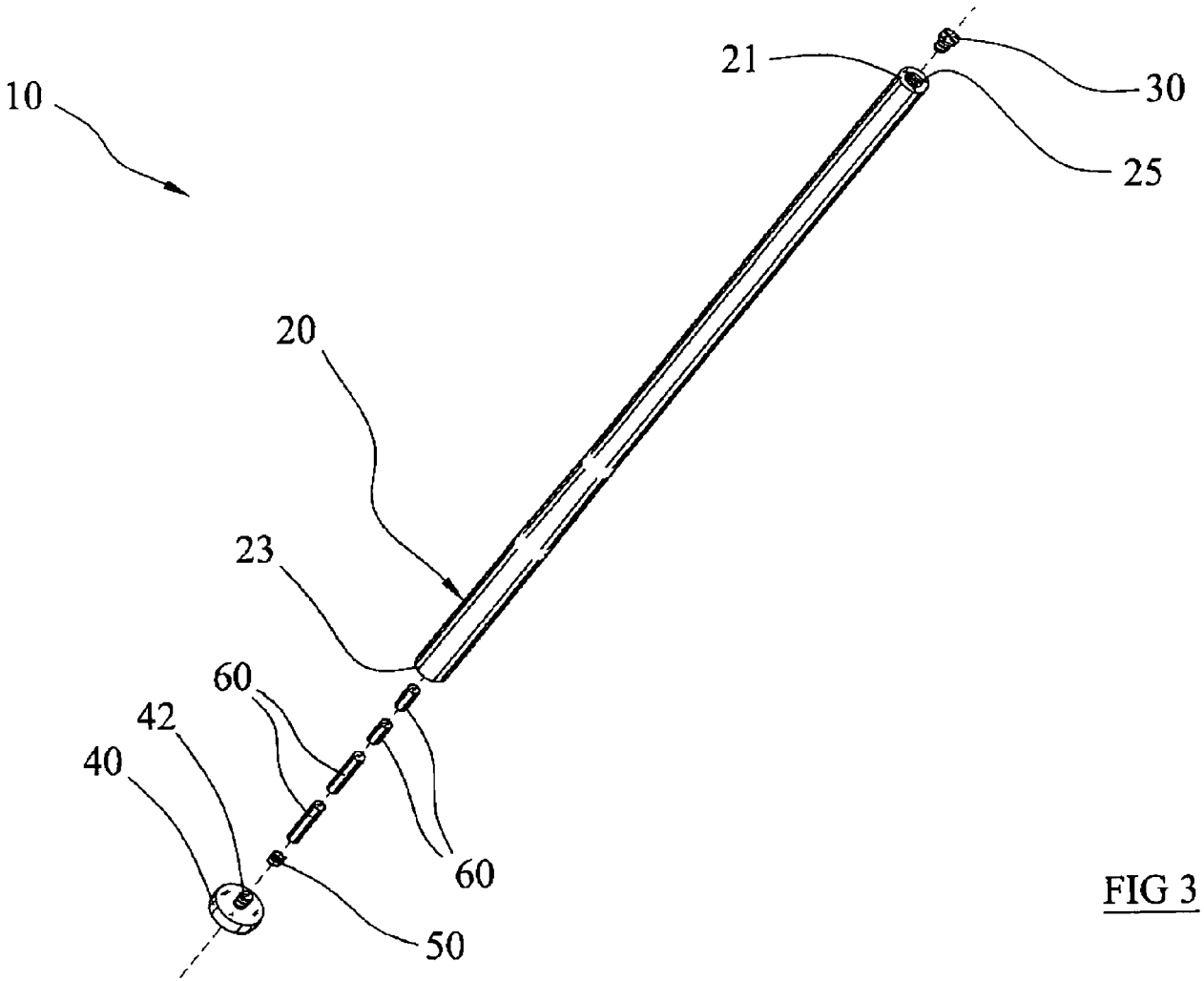
FIG. 3 is an exploded upper perspective view of the present invention.
Figure 4:
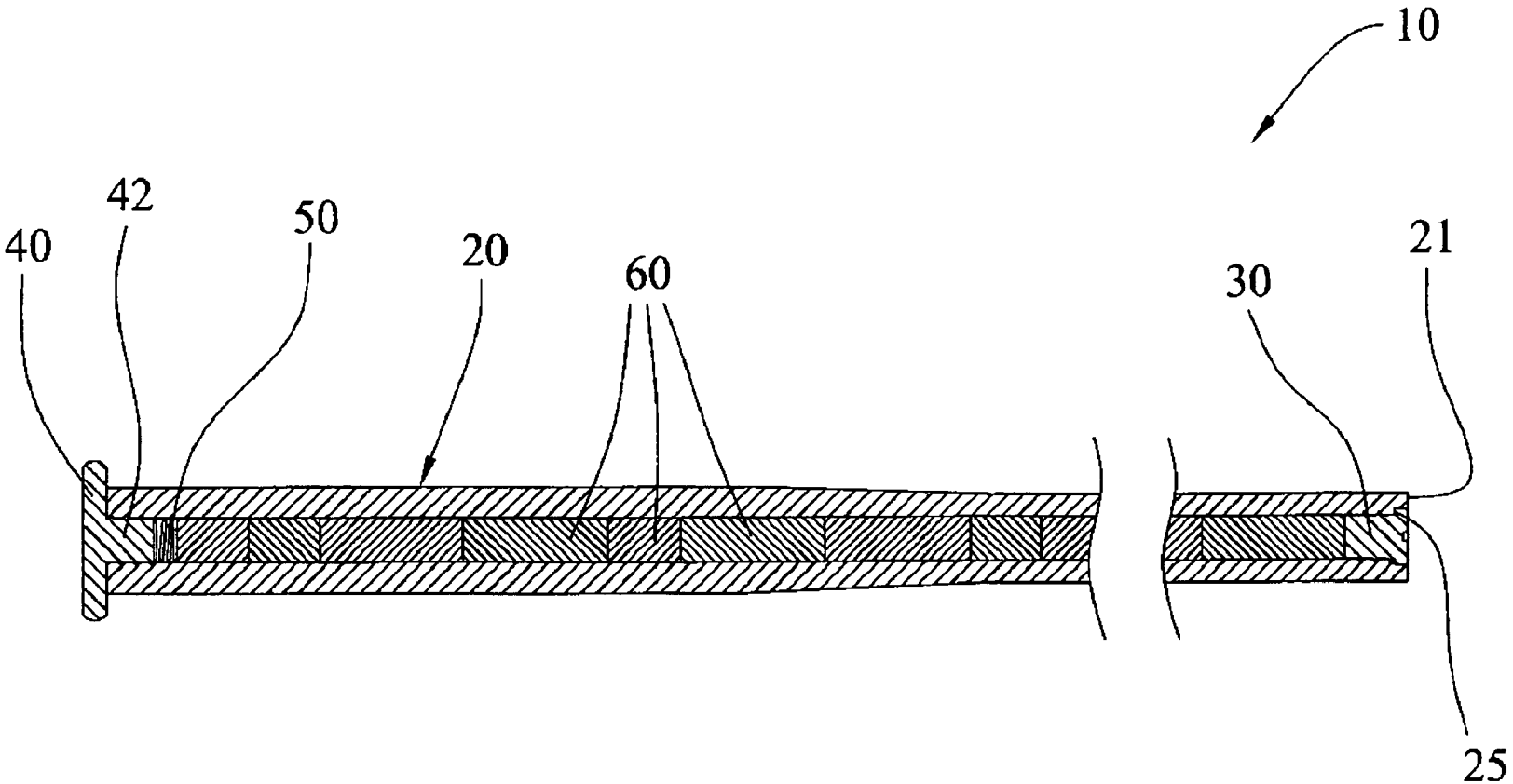
FIG. 4 is a side cutaway view of the present invention.
Figure 5:
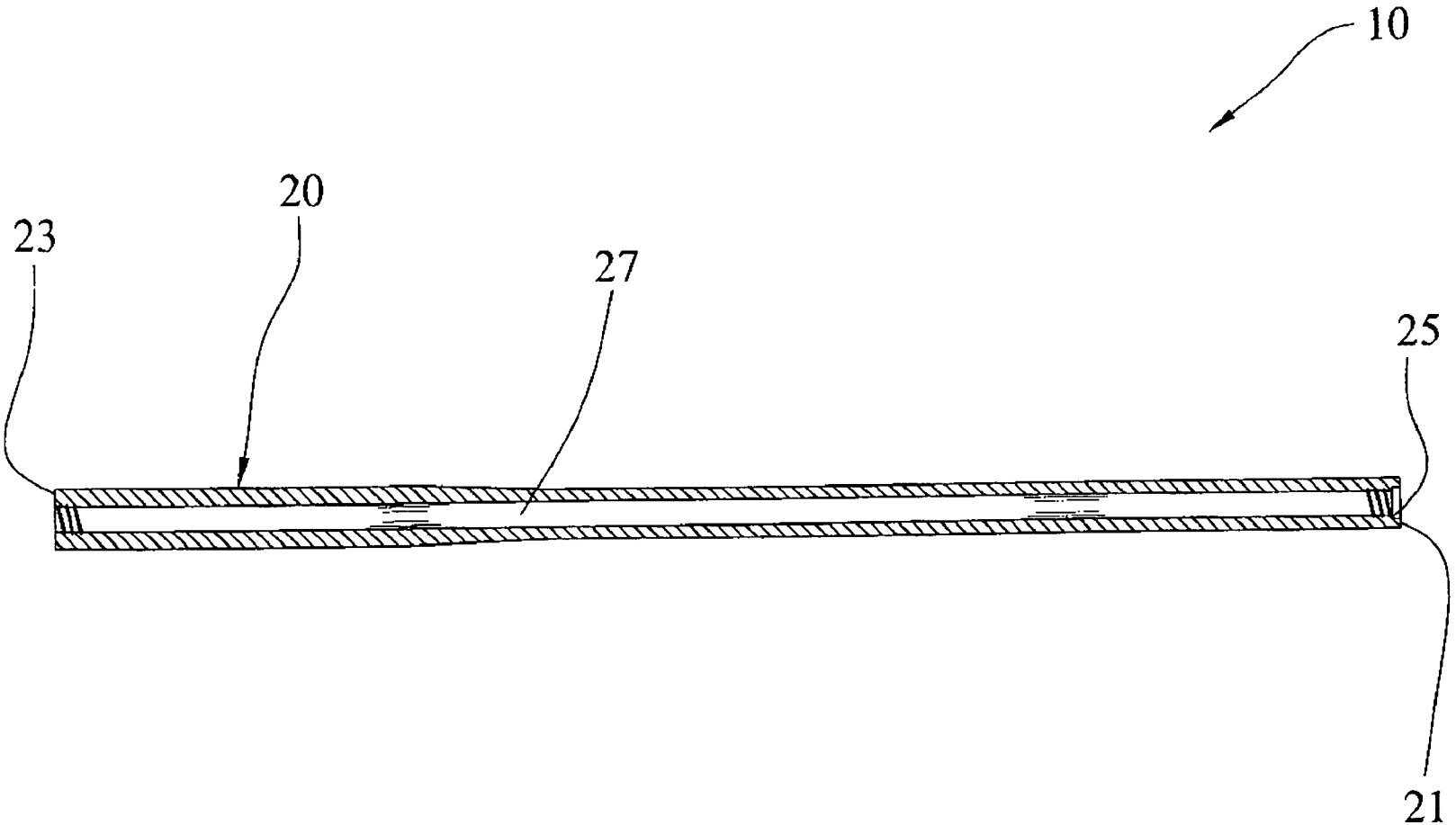
FIG. 5 is a side cutaway view of the present invention with the weights removed from the tubular member.

As shown in FIGS. 1 through 5 of the drawings, the tubular member 20 is an elongate structure having a length similar to the length of a conventional bat. The tubular member 20 has an open distal end 21 and an open inner end 23 which are both interiorly threaded as best illustrated in FIG. 5 of the drawings. It can be appreciated that either the distal end 21 or the inner end 23 may be a closed structure as only one end is required to input the weight members 60 within the tubular member 20.

The tubular member 20 is comprised of a relatively rigid material such as but not limited to metal, plastic, polymer, or similar material. A suitable polymer material for the tubular member 20 is manufactured by DUPONT under the trademark KEVLAR. The tubular member 20 in the preferred embodiment is made of aluminum.

The tubular member 20 has a center bore 27 that extends from the inner end 23 to the distal end 21 thereof as best shown in FIG. 5 of the drawings. The bore 27 may stop before or extend through the distal end 21 of the tubular member 20. The bore 27 is preferably comprised of a consistent diameter, however the bore 27 may be comprised of varying diameters to accommodate similar sized weight members 60. The bore 27 may have various cross sectional shapes such as but not limited to circular, square and the like.

The exterior portion of the tubular member 20 has approximately the same outer diameter as a conventional bat for the user to grasp. The tubular member is approximately the same diameter along its entire length. Thus, the tubular member 20 diameter at the end for hitting the ball is considerably smaller than a conventional bat thereby making it relatively difficult for a user to engage a ball. The tubular member's 20 length is approximately the same as a regular bat.

The distal end 21 of the tubular member 20 is interior threaded within the bore 27 as best shown in FIG. 5 of the drawings. A recessed cavity 25 is preferably positioned within the distal end 21 of the tubular member 20 for allowing the outer cap 30 to be threadably inserted within relatively flush with the distal end 21 as shown in FIGS. 4 and 5 of the drawings. The outer cap 30 may have one or more slots for allowing a tool to engage for removal and insertion thereof within the tubular member 20.

As shown in FIGS. 1 through 4 of the drawings, an inner cap 40 having a threaded extended portion 42 is threadably engageable within the inner end 23 of the tubular member 20. The inner cap 40 preferably have a flanged structure that is similar to an inner portion of a conventional baseball bat. A compression spring 50 may be inserted after the inner cap 40 for maintaining the weight members 60 in a compressed structure as shown in FIG. 4 of the drawings.

As shown in FIGS. 3 and 4 of the drawings, a plurality of weight members 60 are provided that are removably inserted into the bore 27 of the tubular member 20 from either/both the inner end 23 and the distal end 21. The weight members 60 have an outer shape similar to the shape of the bore 27. The weight members 60 are formed to slidably fit within the bore 27 with reduced movement within the bore 27. The weight members 60 are preferably comprised of various lengths and weights to allow for the user to balance the tubular member 20 to simulate the weight and balance of their regular bat he would use in a game or a heavier bat. The weight members 60 may be comprised of various materials such as but not limited to metal, plastic, polymers and other well-known materials. The lengths of the weight members 60 may range from 0.5 to 8 inches.

In use, the user inserts a plurality of weight members 60 into the bore 27 of the tubular member 20 based upon an estimated overall weight of the normal bat he would use in a game. The user is able to insert heavier/denser weight members 60 comprised of metal within locations along the bore 27 in order to increase the weight of a specific section. The user is able to insert lighter weight members 60 comprised of plastic or other materials within locations along the bore 27 in order to decrease the weight of a specific section. The user then secures the inner cap 40 and the outer cap 30 with the compression spring 50 positioned between the inner cap 40 and the weight members 60 thereby maintaining the weight members 60 in a compressed state within the tubular member 20.

The user uses this training bat 10 to hit with in batting practice. Since the end of the tubular member 20 used to engage the ball when batting is much smaller than a conventional bat the user must focus both physically and mentally on making contact with the ball than when using a conventional bat. A smaller, lighter ball can also be used to further increase the mental and physical concentration. Thus, the bat training system 10 will improve the user hitting ability by causing him to concentrate and focus more on hitting the ball. It will also improve his hand/eye coordination.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for improving hitting, comprising:

a ball of the same size and shape as a baseball or softball; and, a baseball bat for hitting the ball comprising;

a cylindrical tube whose length is similar to a conventional baseball bat and, whose outer diameter over an area used for hitting the ball is smaller then the diameter of a conventional baseball bat over an area used for hitting the ball, and whose outer surface is uniform, having a bore of consistent diameter which extends from an inner end to a distal end of said tubular cylindrical tube and said member cylindrical tube is made out of a material that will not be damaged when said cylindrical tube is used to strike the ball;

a plurality of weight members which vary as to length, density, and weight that are adapted to fit slidebly within the bore and said weight members can be placed in the boar or removed from the boar and there are more weight members than necessary to fill the cylindrical so that said weight member can be placed within the boar in different combination and mixtures with the combinations to change the balance and weigh of the bat and make said weigh and balance similar to to a conventional bat; and a means to compress said weight members within said boar to ensure that the weights do not move; and, an inner cap attachable to said inner end of said tubular member for retaining said weight members within said bore.

2. The training bat system of claim 1, wherein the weight members are made out of several materials.

3. The training bat system of claim 1, wherein said inner cap has a flanged portion and an extended portion.

4. The training bat system of claim 1, wherein said extended portion is threaded for threadably engaging an interiorly threaded portion of said inner end.

5. The training bat system of claim 1, wherein the means for compressing is a compression spring positioned between said weight members and said inner cap.

6. The training bat system of claim 1, wherein said tubular member is comprised of a plastic material.

7. The training bat system of claim 1, wherein said tubular member is comprised of aluminum.

8. A training bat system as in claim 1, further comprising:

an outer cap attachable to said distal end of said tubular member for retaining said weight members within said bore.

9. The training bat system of claim 8, wherein the weight members are made out of several materials.

10. The training bat system of claim 8, wherein said inner cap has a flanged portion and an extended portion.

11. The training bat system of claim 8, wherein said extended portion is threaded for threadably engaging an interiorly threaded portion of said inner end.

12. The training bat system of claim 8, wherein the means for compressing is a compression spring positioned between said weight members and said inner cap.

13. The training bat system of claim 8, wherein said tubular member is comprised of a plastic material.

14. The training bat system of claim 8, wherein said tubular member is comprised of aluminum.

* * * * *